United States Patent [19]

Iding

[11] Patent Number: 4,630,408

[45] Date of Patent: Dec. 23, 1986

[54] ROTARY FINISHING WHEEL

[75] Inventor: Joseph P. Iding, Wauwatosa, Wis.

[73] Assignee: M. P. Iding Disc Grinding Compound Co., Inc., Milwaukee, Wis.

[21] Appl. No.: 827,666

[22] Filed: Feb. 7, 1986

Related U.S. Application Data

[63] Continuation of Ser. No. 749,317, Jun. 26, 1985, abandoned, which is a continuation-in-part of Ser. No. 646,780, Sep. 4, 1984, abandoned.

[51] Int. Cl.[4] ..... B24D 13/04

[52] U.S. Cl. ..... 51/337; 51/168; 15/183; 15/230.14

[58] Field of Search ..... 51/168, 330, 332, 334, 51/335, 336, 337; 15/104.14, 179, 181, 183, 198, 230.14, 230.16, 230.19

[56] References Cited

U.S. PATENT DOCUMENTS

| | | | |
|---|---|---|---|
| 244,699 | 7/1881 | Ware | 51/168 |
| 1,142,296 | 6/1915 | Bellerose | 51/168 |
| 3,058,269 | 10/1962 | Block | 51/337 |
| 3,800,481 | 4/1974 | Belanger | 51/337 |
| 3,807,099 | 4/1974 | Belanger | 51/337 |
| 3,846,942 | 11/1974 | Belanger | 51/334 |
| 3,869,833 | 3/1975 | Belanger | 51/334 |

FOREIGN PATENT DOCUMENTS

| | | | |
|---|---|---|---|
| 02526 | 11/1980 | PCT Int'l Appl. | 51/334 |

*Primary Examiner*—Robert P. Olszewski

*Attorney, Agent, or Firm*—Andrus, Sceales, Starke & Sawall

[57] ABSTRACT

The finishing or polishing wheel comprises a flap pack hub spaced from the axis of the wheel and a drive hub mounted on a rotary shaft and carrying the flap pack hub. The flap pack hub includes an axially extending reach disposed between a pair of opposed radially extending reaches to form an annular peripheral recess that opens radially outward. An array of axially extending, circumferentially and equidistantly spaced pins span the recess between the opposed radially extending reaches. A finishing flap pack is mounted on each pin and extends outwardly therefrom.

9 Claims, 6 Drawing Figures

ROTARY FINISHING WHEEL

This application is a continuation of application Ser. No. 749,317, filed June 26, 1985, entitled 'Rotary Finishing Wheel', now abandoned, and which is a continuation-in-part of abandoned application Ser. No. 646,780, filed Sept. 4, 1984.

NATURE AND SUMMARY OF THE INVENTION

This invention relates to a finishing or polishing wheel of the type that mounts a plurality of abrasive cloth flap packs in circumferential array at its periphery.

Broadly according to the invention, an annular hub is spaced from the wheel axis and includes an axially extending reach and a radially extending reach extending outwardly from the respective ends of the axially extending reach. A plurality of pins extend axially between the outwardly extending reaches. The pins are equidistantly spaced from the wheel axis in circumferential array. An abrasive cloth flap pack is mounted on each of the pins. The wheel further includes a drive hub for mounting on a rotatable shaft. An inwardly projecting portion on the axially extending reach is drivingly engageable with the drive hub.

According to a further aspect of the invention, the flap pack hub comprises a pair of opposed annular frame members each of which includes an intermediate axially extending reach between a radially inward extending reach and a radially outward extending reach. The radially inward extending reach of the respective frame members are disposed in axially adjacent relation so that a peripheral recess that opens radially outward is formed by the intermediate reaches and outwardly extending reaches of the respective frame members. The pins mounting the flap packs are disposed in the recess and extend axially between the outwardly extending reaches.

DESCRIPTION OF THE DRAWING FIGURES

The drawings furnished herewith illustrate the best mode presently contemplated and are described hereinafter.

DESCRIPTION OF THE ILLUSTRATED EMBODIMENT

Figure 1:
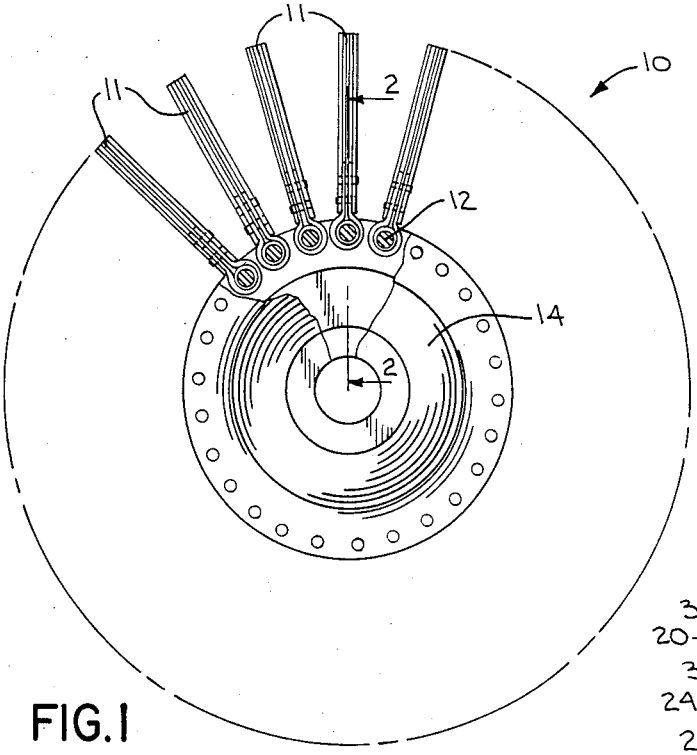
FIG. 1 is an elevational view of a finishing or polishing wheel according to this invention.

Referring to the drawings, the rotatable finishing or polishing wheel 10 carries a plurality of flap packs 11 which are pivotally mounted on axially extending pins 12 equidistantly spaced from the wheel axis in circumferential array. The flap pack wheel 10 generally comprises a composite assembly including an annular outer pack hub 13 which mounts the pack carrying pins 12 and an inner drive hub 14 engaged upon the rotatable drive shaft 15.

Figure 2:
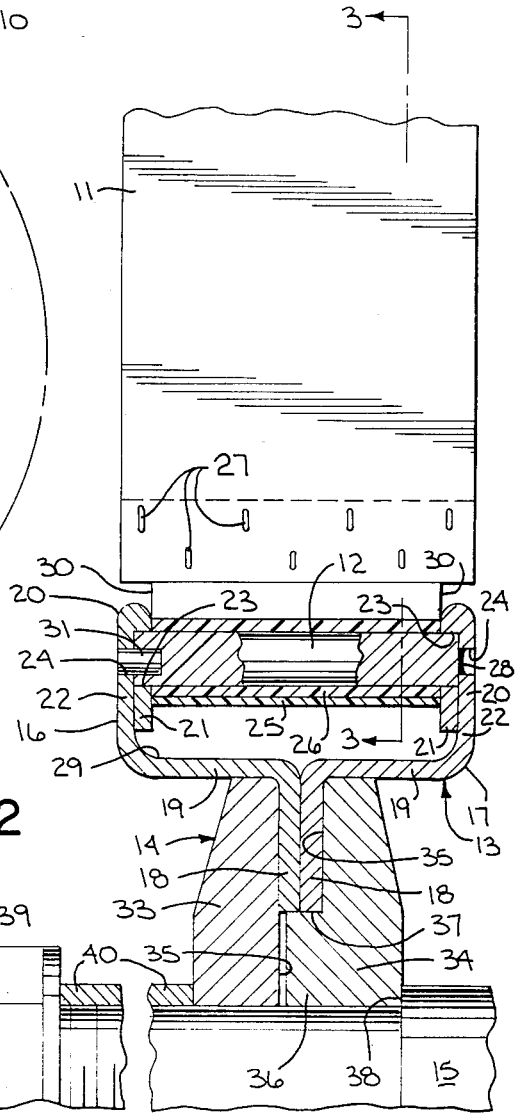
FIG. 2 is a sectional view taken generally on the line 2—2 of FIG. 1.

With reference to FIG. 2, the pack carrying hub 13 generally comprises a pair of opposed annular frame members 16 and 17 that are generally identical in shape and size. The frame members are preferably made of steel and fabricated by a cold forming process to each have a radially inward extending reach 18, an intermediate axially extending reach 19, and a radially outward extending reach 20. While the intermediate reaches 19 of the respective frame members 16 and 17 are preferably of equal length as generally shown in FIG. 2, their lengths may be dissimilar to afford accommodation of the pins 12 as will be hereinafter further described. The outer portion of the outwardly extending reach 20 of the respective frame members 16 and 17 is doubled over in the direction of the intermediate reach 19 to generally lay against itself and provide inner and outer flange portions 21 and 22. The doubled over construction of the outer reaches 20 substantially strengthens the outer periphery of the frame members 16 and 17.

The outer reach flange portions 21 and 22 of the respective frame members 16 and 17 are provided with a circumferential array of equidistantly spaced coaxially extending holes 23 and 24. The holes 23 in the inner flange portions 21 have a diameter adapted to receive the pins 12 therein. The holes 24 in the outer flange portion 22 are of lesser diameter and provide for the rigid securement of the pins 12 as explained further hereinafter.

The finishing or polishing flap packs 11 comprise stacked multiple plies of abrasive coated cloth. The cloth may be of cotton, polyester and /or rayon with the abrasive coating generally applied to one side thereof. The cloth plies are arranged to face the abrasive coated sides unidirectionally. A pack mounting tab 25 is looped over a rigid plastic or metal bushing 26 with the respective free ends of the tab being interleaved with the abrasive coated cloth plies at one end of the pack 11 and in spaced relation to each other. A plurality of spaced staples 27 secure the plies and tab ends together to complete the assembly of the pack 11 inclusive with the mounting means therefor. Tab 25 is preferrably a relatively thin fabric of aramid fibers which has been impregnated with rubber to prevent ravel.

In the assembly of the pack hub 13, the metal pins 12 of appropriate length are initially assembled relative to one of the hub frame members 16 or 17. When the frame member 17 is selected, the pins 12 are inserted into the circumferential array of holes 23 in the inner flange portion 21 with the end of the pins being seated in abutting relation with the inner surface of the outer flange portion 22. Permanent securement of the pins 12 relative to the frame member 17 is contemplated as by welding as indicated at 28 in the hole 24 of the flange portion 22.

With the circumferential array of pins 12 secured in place relative to the frame member 17, the packs 11 are loaded onto the frame member with each pin receiving the bushing 26 and looped tab 25 of a corresponding pack and with the abrasive side of the cloth plies facing in the intended direction of rotation. .

After the flap packs 11 are loaded onto the frame member 17, the opposed frame member 16 is added to the assembly with the opposed ends of the circumferential array of pins 12 engaging within the circumferential array of holes 23 of the inner flange portion 21 of the member 16. When the ends of the pins 12 generally abut the inside surface of outer flange portion 22, the inward reaches 18 of the respective frame members 16 and 17 will be disposed in generally adjacent relation as shown in FIG. 2, and the frame members together form the radially opening, peripheral hub recess 29 which is spanned by the axially extending pins 12 carrying the circumferential array of flap packs 11. Since the flap packs 11 must be freely pivotal on the pins 12, the respective ends of the bushing 26 and tab 25 may require trimming as by grinding or other means along the opposed edges as indicated at 30 prior to the assembly of the packs onto the pins to preclude any binding relative to the pack hub frame assembly.

Figure 4:
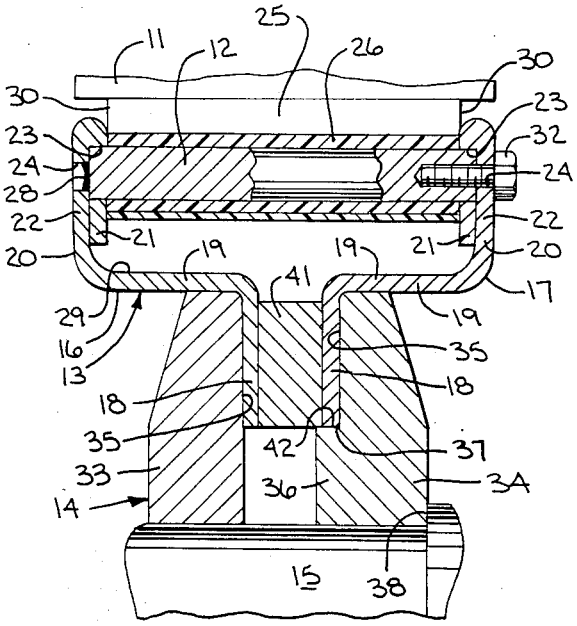
FIG. 4 is a view generally similar to that of FIG. 2 and shows the utilization of a spacer ring to accommodate a relatively wide finishing pack.
Figure 3:
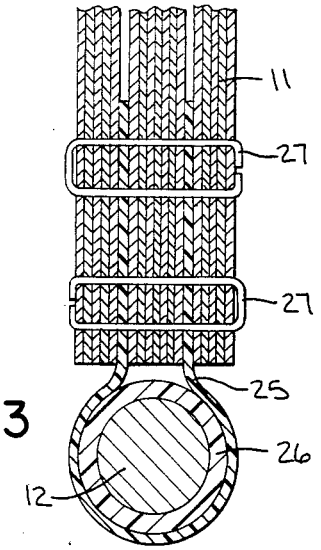
FIG. 3 is a sectional view taken generally on the line 3—3 of FIG. 2.

Assembly of the pack hub 13 is completed by the insertion of fasteners through the holes 24 of the frame member 16 to engage within the ends of the pins 12. If the pack hub 13 is of the throw-away type, wherein a pack hub is simply replaced by another when the flap packs 11 are worn out, non-removable permanent fasteners 31 may be used to complete the assembly. If the pack hub 13 is of the type contemplating hub disassembly to replace the worn out packs 11, removable screws 32 as shown in FIG. 4 may be utilized to complete assembly.

The drive hub 14 for rotatably carrying the annular pack hub 13 comprises a pair of opposed hub plates 33 and 34 carried in turn on the shaft 15. The outside diameter of the hub plates 33 and 34 correspond generally to the inside diameter of the intermediate reaches 19 of the pack hub 13 to provide radial support for the pack hub. The hub plates 33 and 34 have planar facing surfaces 35 generally normal to the axis of the shaft 15 and which frictionaly sandwich therebetween the inward reaches 18 of the frame members 16 and 17. The respective plates 33 and 34 are dimensionally similar both axially and radially, except that the plate 34 is provided with an axially extending annular projection 36 on its planar surface 35 which, in assembled relation with the pack hub 13, projects into the central hole 37 interiorly of the inward reaches 18 of the annular pack hub. The axial depth of the annular projection 36 must exceed the thickness of the material of one pack hub frame member. Thus, when assembled with the pack hub 13, the projection 36 on hub plate 34 will remain spaced from the planar surface 35 of the opposed hub plate 33, and the inward reaches 18 of the pack hub frame members 16 and 17 will be disposed in a radial plane centrally of the drive hub 14.

The drive hub 14 of the flap pack wheel 10 may be secured onto the drive shaft 15 between a radial shoulder 38 on the shaft and securement means such as the nut 39 threaded onto the end of the shaft. If required, a spacer ring 40 may be interposed between the nut 39 and the drive hub 14.

The width of the flap packs 11 employed on a given wheel 10 are generally similar and determined by the nature of the workpiece being finished or polished. Thus, wheels 10 must be available to accommodate a relatively wide range of flap pack widths. To do so, the frame members 16 and 17 may be made available having axially extending reaches 19 in different length multiples. As mentioned previously, while the intermediate axially extending reaches 19 of the respective frame members 16 and 17 are preferably of equal length, their lengths may be dissimilar to accommodate pins 12 corresponding to a desired flap pack width. In the embodiment of FIG. 4 an annular spacer member 41 of appropriate axial extent is interposed between the inward reaches 18 of the frame members 16 and 17 and held in place by the annular shoulder 42 formed by the axial hub plate projection 36 to accommodate pins 12 corresponding to the desired flap pack width. If a given workpiece so requires, two (2) flap pack wheels 10 may be mounted side-by-side on a single shaft with a suitable spacer ring 40 therebetween. Thus, the composite flap pack wheel 10 can be made to accommodate a wide range of pack widths to satisfy most workpiece requirements.

Figure 5:
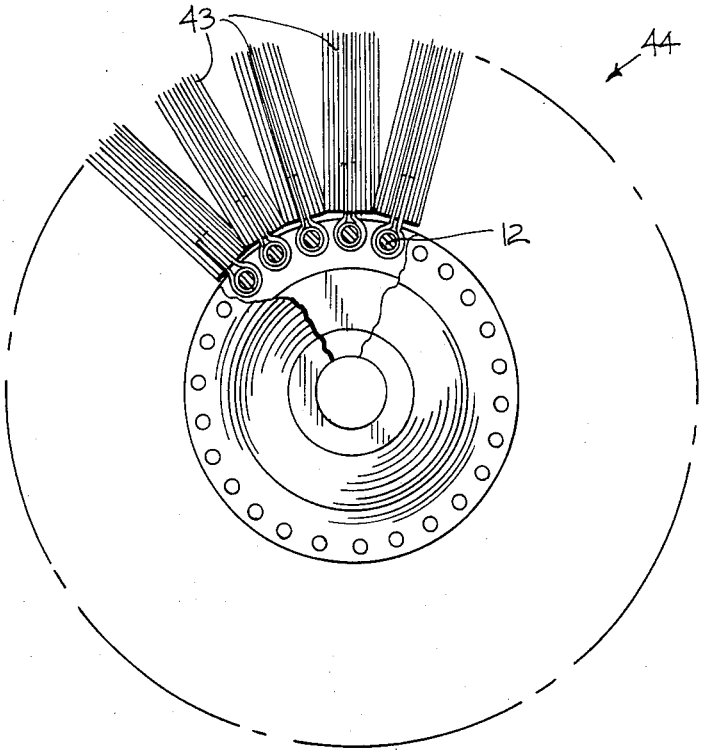
FIG. 5 is a view generally similar to that of FIG. 1 and shows a further embodiment of a finishing or polishing wheel according to the invention.
Figure 6:
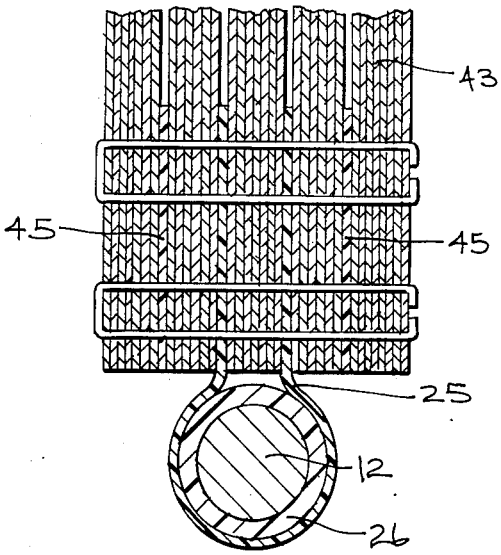
FIG. 6 is a view generally similar to that of FIG. 3 and shows a flap pack as employed in the wheel of FIG. 5.

According to the embodiment of FIGS. 5 and 6, a thicker flap pack 43 is carried on the finishing or polishing wheel 44. As perhaps best shown in FIG. 6, the thickness of the pack 43 substantially exceeds the diameter of the loop formed by the mounting tab 25. Even while the packs 43 are mounted similarly as packs 11 on the mounting pins 12 with an intervening bushing 26, the thicker packs are generally forced into the periphery of the pins on the wheel 44 with contact between the inner end portions of adjacent packs to generally preclude rotation or pivoting of the packs relative to the pins in service. As a consequence, the individual plies of the pack assembly flex outwardly in service from the stapled inner end portion. To provide for and better control the flexion of the plies of the packs 43 in service, relatively short spacer plies 45 may be interleaved as desired among the abrasive coated plies at the inner end of the packs as generally shown in FIG. 6. The finishing or polishing wheel 44 may be characterized as providing for a more aggresive cutting action in service.

Various modes of carrying out the invention are contemplated as being within the scope of the following claims particularly pointing out and distinctly claiming the subject matter which is regarded as the invention.

I claim:

1. In a finishing wheel, a pair of annular frame members each having an axially extending reach, a radially inward extending reach at one end of the axially extending reach and a radially outward extending reach at the other end of the axially extending reach, said pair of annular frame members comprising the only frame members and being disposed to place their respective radially inward extending reaches in axially adjacent relation to form an annular hub wherein the axial reaches of the respective frame members together with their radially outward reaches provide a single radially opening peripheral recess between the opposed outer reaches, a plurality of axially extending pin members spanning said hub recess and being supported solely by mounting directly to the radially outward extending reaches, said pin members being equidistantly spaced relative to the wheel axis and in circumferential array, and a finishing pack mounted on each of the pin members, said annular hub being drivingly mountable on a rotateable shaft in service.

2. The structure as set forth in claim 1 wherein the finishing packs are pivotally mounted on the pin members and capable of pivotal movement in service.

3. The structure as set forth in claim 1 wherein each finishing pack is disposed in contact with the adjacent packs to generally preclude pivotal movement in service.

4. The structure as set forth in claim 1 wherein the radially outward extending reach of the respective frame members is doubled over upon itself in the direction of the intermediate reach to provide axially adjacent flange portions at the outer periphery of the hub, and the respective ends of the pin members are disposed in axially aligned holes provided in the opposed inner flange portions for securement.

5. The structure as set forth in claim 1 wherein a bushing is provided at one end of each flap pack, and a mounting tab is looped over the bushing and extends into the pack for securement, said bushing being disposed on a corresponding pin member to mount the flap pack onto the finishing wheel.

6. The structure set forth as in claim 5 wherein the mounting tab is a fabric made of aramid fibers.

7. The structure as set forth in claim 1 wherein the respective radially inward extending reaches are disposed in abutting relation.

8. The structure as set forth in claim 1 wherein annular spacer means are disposed between the respective radially inward extending reaches.

9. The structure as set forth in claim 1 wherein a drive hub carried on a rotatable shaft sandwiches the radially inward extending reaches of the finishing wheel frame members in service.

* * * * *